US010808631B2

(12) United States Patent
Del Valle Echavarri et al.

(10) Patent No.: US 10,808,631 B2
(45) Date of Patent: Oct. 20, 2020

(54) FUEL BLENDING SYSTEM AND METHOD

(71) Applicant: Guascor Power, S.A., Zumaia, Gipuzkoa (ES)

(72) Inventors: Javier Del Valle Echavarri, Alava (ES); Aiala Fernandez De Gamarra, Alava (ES); Jesus Alvarez, Alava (ES); Erlantz Uriarte, Alava (ES)

(73) Assignee: GUASCOR POWER, S.A., Zumaia, Gipuzkoa (ES)

( * ) Notice: Subject to any disclaimer, the term of this patent is extended or adjusted under 35 U.S.C. 154(b) by 0 days.

(21) Appl. No.: 16/484,730

(22) PCT Filed: Feb. 15, 2017

(86) PCT No.: PCT/US2017/017907

§ 371 (c)(1),
(2) Date: Aug. 8, 2019

(87) PCT Pub. No.: WO2018/151715

PCT Pub. Date: Aug. 23, 2018

(65) Prior Publication Data

US 2019/0390616 A1 Dec. 26, 2019

(51) Int. Cl.
*F02D 19/06* (2006.01)
*F02D 19/08* (2006.01)
(Continued)

(52) U.S. Cl.
CPC ..... *F02D 19/0673* (2013.01); *F02D 19/081* (2013.01); *F02D 19/0665* (2013.01);
(Continued)

(58) Field of Classification Search
CPC ..... F02D 19/0673; F02D 19/081; F02D 19/0694; F02D 19/0665; F02M 37/20; F02M 37/0064; Y02T 10/36
See application file for complete search history.

(56) References Cited

U.S. PATENT DOCUMENTS 4,594,201 A * 6/1986 Phillips ..... F02M 13/06 123/511
5,469,830 A 11/1995 Gonzalez
(Continued)

FOREIGN PATENT DOCUMENTS

WO 9535356 A1 12/1995

OTHER PUBLICATIONS

PCT International Search Report and Written Opinion dated Nov. 8, 2017 corresponding to PCT Application No. PCT/US2017/017907 filed Feb. 15, 2017.

*Primary Examiner* — Erick R Solis

(57) ABSTRACT

A system and method are provided for blending a first fuel from a first fuel source with a second fuel from a second fuel source. The system may include a controller communicatively coupled with each of a plurality of sensors, a first plurality of valves including a first progressive valve, and a second plurality of valves including a second progressive valve. The first and second plurality of valves may be configured to selectively enable fluid communication between the first and second fuel sources and a power generation unit. The controller may be configured to receive a detected operating parameter from a sensor, compare the detected operating parameter to another operating parameter, and based on the comparison, transmit an instruction to at least one of the first progressive valve and the second progressive valve to enable the first fuel to blend with the second fuel before entering the power generation unit.

6 Claims, 2 Drawing Sheets

(51) Int. Cl.
*F02M 37/00* (2006.01)
*F02M 37/20* (2006.01)

(52) U.S. Cl.
CPC ..... *F02D 19/0694* (2013.01); *F02M 37/0064* (2013.01); *F02M 37/20* (2013.01)

(56) References Cited

U.S. PATENT DOCUMENTS 5,911,210 A 6/1999 Flach
2002/0040692 A1* 4/2002 LaPointe ..... F02B 1/04 123/27 GE
2002/0185086 A1* 12/2002 Newman ..... F02D 19/0647 123/1 A
2004/0025831 A1* 2/2004 Landi ..... F02D 19/02 123/304
2004/0177837 A1* 9/2004 Bryant ..... F02B 29/0412 123/559.1
2008/0121218 A1* 5/2008 Algrain ..... F02B 37/013 123/565
2008/0178848 A1* 7/2008 Duffy ..... F02D 41/0065 123/481
2009/0183716 A1* 7/2009 Kojima ..... F02M 21/06 123/511
2009/0287391 A1* 11/2009 Duineveld ..... F02D 19/0628 701/103
2009/0320789 A1* 12/2009 Lund ..... F02D 19/0652 123/299
2011/0088657 A1* 4/2011 Tanno ..... F02D 35/028 123/305
2012/0143480 A1* 6/2012 Pursifull ..... F02D 19/0615 701/105
2013/0125867 A1* 5/2013 Krug ..... F02M 37/0088 123/575
2013/0167810 A1* 7/2013 Roplekar ..... F02D 41/045 123/564
2014/0202420 A1* 7/2014 Jaasma ..... F02B 17/005 123/304
2014/0261322 A1* 9/2014 Geckler ..... F02D 41/0065 123/445
2014/0305409 A1* 10/2014 Arndt ..... F02M 21/0287 123/446
2015/0034058 A1* 2/2015 Nishikawa ..... F02M 37/00 123/575
2015/0136097 A1* 5/2015 Hoshi ..... F02D 19/0615 123/575
2015/0219027 A1* 8/2015 zur Loye ..... F02D 41/0027 60/603
2016/0084172 A1* 3/2016 Ten Broeke ..... F02D 41/3845 123/468
2016/0160807 A1* 6/2016 Polcyn ..... F02M 26/06 123/568.11
2016/0281619 A1* 9/2016 Kale ..... F01N 3/2066
2017/0009670 A1* 1/2017 Sorge ..... F02D 19/0615
2017/0298850 A1* 10/2017 Kurtz ..... F02D 19/0665
2018/0171890 A1* 6/2018 Kamei ..... F02D 41/3035

* cited by examiner

FUEL BLENDING SYSTEM AND METHOD

BACKGROUND

Methane-rich waste fuel may be produced during the course of operating certain processing plants (e.g., garbage landfills and sewage treatment plants). In view of environmental concerns related to greenhouse gases and as a manner of cost savings, some operators of such processing plants have installed power generating equipment powered by the methane-rich waste fuel and capable of generating electrical, mechanical, and/or thermal energy therefrom. Accordingly, the generated electrical, mechanical, and/or thermal energy may be used to power components of the processing plants. However, as the supply and/or composition of methane-rich waste fuel may be inconsistent over time, such power generating equipment may be configured to operate based on other fuel supplies, such as pipeline fuels, in order to maintain sufficient electrical, mechanical, and/or thermal energy to the components of the processing plants.

Based on the foregoing, control systems utilizing a plurality of valves have been implemented to regulate the type of fuel supplied to the power generating equipment based at least in part on the operating conditions of the power generating equipment and the supply and/or composition of the methane-rich waste fuel and pipeline fuel. Typically, in cases of transitioning the fuel supplied to the power generating equipment from methane—rich waste fuel to the pipeline fuel, or vice versa, the power generating equipment cannot be operated at maximum power due to undesirable exhaust emissions and the occurrence of knocking or misfiring based on the leakage of one or more of the valves utilized. In turn, the energy output of the power generating equipment is reduced, resulting in less electrical, mechanical, and/or thermal energy supplied to the components of the processing plants.

What is needed, therefore, is a system and method for transitioning the fuel supplied to the power generating equipment from methane—rich waste fuel to the pipeline fuel, or vice versa, while operating the power generating equipment at maximum power without excessive exhaust emissions and the occurrence of knocking or misfiring.

SUMMARY

Embodiments of this disclosure may provide a fuel blending system for a power generation unit fluidly coupled to a first fuel source and a second fuel source. The fuel blending system may include a plurality of sensors, a first plurality of valves, a second plurality of valves, and a controller. Each sensor of the plurality of sensors may be configured to detect at least one operating parameter of the power generation unit. The first plurality of valves may be configured to selectively prevent or enable fluid communication between the first fuel source and the power generation unit. The first plurality of valves may be fluidly coupled in series and include a first progressive valve configured to gradually open or close to at least one predetermined setpoint. The second plurality of valves may be configured to selectively prevent or enable fluid communication between the second fuel source and the power generation unit. The second plurality of valves may include a second progressive valve configured to gradually open or close to at least one predetermined setpoint. The controller may be communicatively coupled to each of the plurality of sensors, each valve of the first plurality of valves, and each valve of the second plurality of valves. The controller may be configured to receive a detected operating parameter from a sensor of the plurality of sensors, compare the detected operating parameter to another operating parameter, and based on the comparison, transmit an instruction to at least one of the first progressive valve and the second progressive valve to enable a first fuel from the first fuel source to blend with a second fuel from the second fuel source.

Embodiments of this disclosure may further provide a power generation system. The power generation system may include a system load, a power generation unit, and a fuel blending system. The power generation unit may be configured to receive a first fuel from a first fuel source, a second fuel from a second fuel source, or a combination thereof and generate useful energy therefrom to power the system load. The fuel blending system may be operatively coupled to at least one of the power generation unit and the system load. The fuel blending system may include a plurality of sensors, a first plurality of valves, a second plurality of valves, and a controller. Each sensor of the plurality of sensors may be configured to detect at least one operating parameter of at least one of the power generation unit and the system load. The first plurality of valves may be configured to selectively prevent or enable fluid communication between the first fuel source and the power generation unit. The first plurality of valves may be fluidly coupled in series and include a first progressive valve configured to gradually open or close to at least one predetermined setpoint. The second plurality of valves may be configured to selectively prevent or enable fluid communication between the second fuel source and the power generation unit. The second plurality of valves may include a second progressive valve configured to gradually open or close to at least one predetermined setpoint. The controller may be communicatively coupled to each of the plurality of sensors, each valve of the first plurality of valves, and each valve of the second plurality of valves. The controller may be configured to receive a detected operating parameter from a sensor of the plurality of sensors, compare the detected operating parameter to another operating parameter, and based on the comparison, transmit an instruction to at least one of the first progressive valve and the second progressive valve to enable a first fuel from the first fuel source to blend with a second fuel from the second fuel source.

Embodiments of this disclosure may further provide a method for blending a first fuel from a first fuel source with a second fuel from a second fuel source. The method may include flowing the second fuel from the second fuel source through a second plurality of valves to a power generation unit. The second plurality of valves may be configured to selectively enable the second fuel source to fluidly communicate with the power generation unit. The method may also include opening a first shut-off valve of a first plurality of valves. The first plurality of valves may be configured to selectively enable the first fuel source to fluidly communicate with the power generation unit. The method may further include opening a first progressive valve of the first plurality of valves at a first rate to a first setpoint. The first progressive valve may be configured to gradually open at the first rate to the first setpoint. The method may also include opening a first flow control valve of the first plurality of valves. The first flow control valve may be configured to regulate an amount of the first fuel to be blended with the second fuel. The method may further include blending the first fuel with the second fuel to a form a blended fuel in an intake manifold prior to the blended fuel entering the power generation unit.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
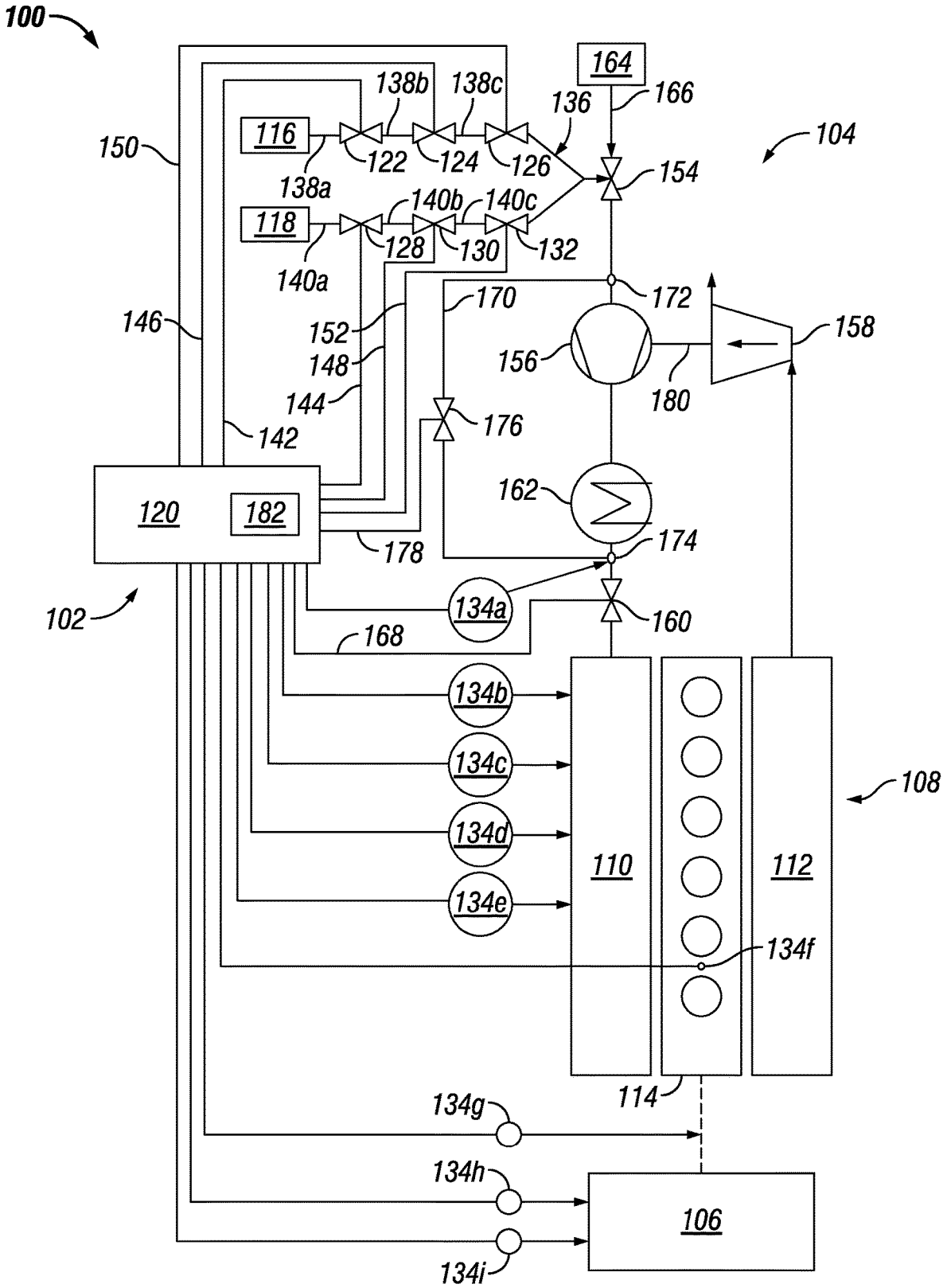
FIG. 1 illustrates a schematic of an exemplary power generation system, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a schematic of an exemplary power generation system 100, according to one or more embodiments. The power generation system 100 may include a fuel control system 102 operatively coupled to a power generation unit 104, and in some embodiments, a system load 106. The power generation unit 104 may include an engine 108 configured to drive the system load 106. As shown in FIG. 1, the engine 108 may be an internal combustion engine having an inlet manifold 110, an exhaust manifold 112, and a combustion chamber 114 positioned therebetween. The engine 108 may be, for example, a multi-bank, in-line, or V-engine of any power output, naturally aspirated or turbocharged. The system load 106 may typically be a generator; however, other loads or machines, such as, for example, compressors, pumps, or the like are contemplated within the scope of this disclosure.

The power generation system 100 may be in fluid communication with a plurality of fuel sources including a pipeline fuel source 116 and an alternative fuel source 118. In one or more embodiments, the pipeline fuel source 116 may be a hydrocarbon well, a hydrocarbon storage tank, or a pipeline carrying hydrocarbons. In one or more embodiments, the alternative fuel source 118 may be a landfill, a sewage treatment plant, or the like. Accordingly, the power generation system 100 may be powered by a pipeline fuel, an alternative fuel, or combinations (e.g., blends) thereof. In one or more embodiments, the alternative fuel may be methane or a methane-rich fuel, such as, for example, biogas or landfill gas. In another embodiment, the alternative fuel may be syngas. The pipeline fuel may be a fossil fuel such as liquid petroleum or natural gas. In instances in which the pipeline fuel source 116 may be located offsite from the power generation unit 104, the pipeline fuel may be often supplied from a third party, and thus, it may be desirable to power the power generation unit 104 via the alternative fuel as much as possible.

As noted above, the fuel control system 102 may be operatively coupled to the power generation unit 104, and as such, the fuel control system 102 may be configured to regulate the transitioning of fuel supplied to the engine 108 of the power generation unit 104 from the alternative fuel, to a blend of the alternative fuel and pipeline fuel, and to the pipeline fuel, or vice versa, while operating the engine 108 at maximum power while maintaining exhaust emissions and avoiding knocking or misfiring of the engine 108. To that end, the fuel control system 102 may include, amongst other components, a controller 120, a plurality of valves 122, 124, 126, 128, 130, 132, and a plurality of sensors 134*a-i*.

Each of the plurality of valves 122, 124, 126, 128, 130, 132 and the plurality of sensors 134*a-i* may be communicatively coupled with the controller 120, such that information relayed from the plurality of sensors 134*a-i* to the controller 120 may be utilized to determine instructions sent to one or more of the plurality of valves 122, 124, 126, 128, 130, 132 via the controller 120 to regulate the amount of pipeline fuel and/or alternative fuel received by the power generation unit 104. In addition, one or more of the plurality of valves 122, 124, 126, 128, 130, 132 may send information (e.g., valve position) to the controller 120. In one or more embodiments, at least two of the plurality of valves 122, 124, 126, 128, 130, 132 may communicate in two directions with the controller 120, thereby being capable of sending information to and receiving information from the controller 120.

Each of the fuel sources 116, 118 may be selectively fluidly coupled to the power generation unit 104 via the fuel control system 102. In particular, as shown in FIG. 1, the pipeline fuel source 116 may be fluidly coupled with the power generation unit 104 via a Y-shaped intake manifold 136 and a series of lines 138*a-c* selectively fluidly coupled with one another via valves 122, 124, and 126 of the fuel control system 102. Correspondingly, the alternative fuel source 118 may be fluidly coupled with the power generation unit 104 via the Y-shaped intake manifold 136 and a series of lines 140*a-c* selectively fluidly coupled with one another via valves 128, 130, and 132 of the fuel control system 102.

The valve 122 may be fluidly coupled with the pipeline fuel source 116 via line 138*a* and may be operatively coupled to the controller 120 via a communication line 142. Although illustrated in a wired communication via the communication line 142, it will be appreciated that the valve 122 may communicate with the controller 120 wirelessly in at least one embodiment. The valve 122 may be referred to as a shut-off valve and may be configured to selectively prevent or enable fluid communication between the pipeline fuel source 116 and the power generation unit 104. Similarly, valve 128 may be fluidly coupled with the alternative fuel source 118 via line 140*a* and may be operatively coupled to the controller 120 via a communication line 144. Although illustrated in a wired communication via communication line 144, it will be appreciated that the valve 128 may communicate with the controller 120 wirelessly in at least one embodiment. The valve 128 may be referred to as a shut-off valve and may be configured to selectively prevent or enable fluid communication between the alternative fuel source 118 and the power generation unit 104. In one or more embodiments, each of the valves 122, 128 may be configured to operate in a fully-opened position or a fully-closed position via an instruction in the form of a digital signal sent by the controller 120.

The valve 124 may be fluidly coupled with the valve 122 via line 138*b* and may be operatively coupled to the controller 120 via a communication line 146. Although illustrated in a wired communication via the communication line 146, it will be appreciated that the valve 124 may communicate with the controller 120 wirelessly in at least one embodiment. The valve 124 may be referred to as a progressive valve and may be configured to selectively gradually enable or prevent fluid communication between the pipeline fuel source 116 and the power generation unit 104. Similarly, valve 130 may be fluidly coupled with the valve 128 via line 140*b* and may be operatively coupled to the controller 120 via a communication line 148. Although illustrated in a wired communication via the communication line 148, it will be appreciated that the valve 130 may communicate with the controller 120 wirelessly in at least one embodiment. The valve 130 may be referred to as a progressive valve and may be configured to selectively gradually enable or prevent fluid communication between the alternative fuel source 118 and the power generation unit 104. In one or more embodiments, each of the valves 124, 130 may be configured to gradually open or close during the transition of fuel supplied to the power generation unit 104 from the alternative fuel, to a blend of the alternative fuel and pipeline fuel, and to the pipeline fuel or vice versa. Accordingly, the valves 124, 130 may be set to open or close at a rate that may be changed during the opening or closing of the valves 124, 130. In an exemplary embodiment, each of the valves 124, 130 may be a Globe Control Valve Type 3241 manufactured by Samson Controls Inc. of Baytown, Tex.

The valve 126 may be fluidly coupled with the valve 124 via line 138*c* and may be further fluidly coupled with the power generation unit 104 via the Y-shaped intake manifold 136. The valve 126 may be operatively coupled to the controller 120 via a communication line 150. Although illustrated in a wired communication via the communication line 150, it will be appreciated that the valve 126 may communicate with the controller 120 wirelessly in at least one embodiment. The valve 126 may be referred to as an air fuel ratio (AFR) flow control valve and may be configured to selectively control the volume of pipeline fuel supplied to the power generation unit 104. Similarly, valve 132 may be fluidly coupled with the valve 130 via line 140*c* and may be further fluidly coupled with the power generation unit 104 via the Y-shaped intake manifold 136. The valve 132 may be operatively coupled to the controller 120 via a communication line 152. Although illustrated in a wired communication via the communication line 152, it will be appreciated that the valve 132 may communicate with the controller 120 wirelessly in at least one embodiment. The valve 132 may be referred to as an air fuel ratio (AFR) flow control valve and may be configured to selectively control the volume of alternative fuel supplied to the power generation unit 104.

In one or more embodiments, each of the valves 126 and 132 may be intelligently controlled valves (e.g., smart valves) configured to control the flow of respective fuels into the power generation unit 104. In an exemplary embodiment, each of the valves 126 and 132 may be a Tecjet or Raptor valve (hereafter, "Tecjet valve") manufactured by Woodward Governor Company of Fort Collins, Colo. In one or more embodiments, the valves 126 and 132 may be different Tecjet valves based on the fuel type. Further yet, different types of alternative fuel may call for different Tecjet valves depending on the type of alternative fuel provided.

The plurality of sensors 134*a-i* of the fuel control system 102 may be operatively coupled to the controller 120 and may be utilized to sense or detect various operating parameters of the power generation unit 104 to determine the instructions sent to the valves 122, 124, 126, 128, 130, 132 to thereby control the flow of pipeline and/or alternative fuel into the power generation unit 104. In one or more embodiments, one or more of the sensors 134*a-i* may detect or sense various operating parameters including, but not limited to, inlet manifold pressure, inlet manifold temperature, exhaust manifold temperature, exhaust manifold pressure, engine speed, engine temperature, exhaust emissions, engine knock, engine load, engine timing, and engine coolant temperature. In addition, one or more of the sensors may detect or sense fuel pressure, temperature, flow rate, and composition of each of the pipeline fuel and the alternative fuel. Further yet, one or more of the sensors 134*a-i* may be configured to sense or detect various operating parameters of the system load 106, and in the case of the system load 106 being or including a generator, one or more of the sensors 134*a-i* may sense or detect voltage, current, resistance, power, and frequency.

In addition to the engine 108, the power generation unit 104 may include a mixer 154, a compressor 156, a turbocharger 158, a throttle 160, and an intercooler 162, as illustrated in FIG. 1. The mixer 154 may be fluidly coupled to the Y-shaped intake manifold 136 and may be configured to receive the pipeline fuel, the alternative fuel, or a blend thereof. Prior to entering the mixer 154, a combination of the pipeline fuel and the alternative fuel may be blended by mere contact with one another as the fuels pass through the Y-shaped intake manifold 136. In other embodiments, the Y-shaped intake manifold 136 may include a venturi structure (not shown) to facilitate blending of the fuels.

In the mixer 154, the fuel received therein may be mixed with air provided from an air source 164 and fed to the mixer 154 via line 166. The fuel and the air may be mixed together in the mixer 154 to form a fuel mixture. In at least one embodiment, the mixer 154 may include a nozzle (not shown) and may be positioned upstream of the engine 108. After mixing, the fuel mixture may flow into the compressor 156, which may be fluidly connected to and disposed downstream from the mixer 154. The compressor 156 may be configured to compress the fuel mixture to a pressure suitable for the combustion of the fuel mixture. The compressed fuel mixture may be fed to the intercooler 162, which may be positioned downstream of the compressor 156 and fluidly coupled thereto. The intercooler 162 may be configured to further cool the compressed fuel mixture prior to combustion. The cooled, compressed fuel mixture may be fed to the throttle 160, which may be positioned downstream of the intercooler 162 and the compressor 156, and upstream of the inlet manifold 110 of the engine 108.

The throttle 160 may be configured to control the rate of the fuel mixture entering the inlet manifold 110. As illustrated in FIG. 1, the controller 120 may be operatively coupled to the throttle 160 via a communication line 168. Although illustrated in a wired communication via the communication line 168, it will be appreciated that the throttle 160 may communicate with the controller 120 wirelessly in at least one embodiment. In one or more embodiments, a bypass line 170 may extend from a first point 172 downstream of the mixer 154 to a second point 174 downstream of the intercooler 162 and upstream of the throttle 160. A bypass valve 176 may be fluidly connected to the bypass line 170 and configured to selectively direct the fuel mixture away from the compressor 156 and the intercooler 162. As illustrated in FIG. 1, the controller 120 may be operatively coupled to the bypass valve 176 via a communication line 178. Although illustrated in a wired communication via the communication line 178, it will be appreciated that the bypass valve 176 may communicate with the controller 120 wirelessly in at least one embodiment.

The inlet manifold 110 of the engine 108 may receive the fuel mixture provided thereto via the throttle 160. The fuel mixture may be injected into the combustion chamber 114 of the engine 108, where the fuel mixture may be combusted to produce useful mechanical energy, such as shaft rotation. The shaft rotation may drive the system load 106. In one or more embodiments, the shaft rotation may drive a generator, whereby the generator may produce electrical energy to power components of the power generation system 100. In one or more embodiments, the generator may be coupled to an electrical grid and may supply electrical energy thereto. Exhaust products from combustion within the combustion chamber 114 of the engine 108 may exit from the exhaust manifold 112 and enter into the turbocharger 158. The turbocharger 158 may convert a pressure drop in the exhaust products flowing therethrough to mechanical energy, which may be used to drive the compressor 156 via a rotary shaft 180 coupling the turbocharger 158 and the compressor 156.

Based on the foregoing disclosure, an exemplary operation of the power generation system 100 during the transition of fuel supplied to the engine 108 of the power generation unit 104 from the alternative fuel, to a blend of the alternative fuel and the pipeline fuel, and to the pipeline fuel, and vice versa, will be disclosed. It will be evident from the following that the transition from a first fuel source, to a blend of the first fuel source and a second fuel source, and to the second fuel source may occur without reducing the power output of the engine 108 and without excessive exhaust emissions, engine knocking, or misfiring of the engine 108. In such a transition, the engine 108 may be initially operating on alternative fuel supplied via the alternative fuel source 118. As such, each of valves 128, 132, and 134 may be open such that the engine 108 is operating at maximum power output, and each of the valves 122, 124, and 126 may be closed, thereby preventing pipeline fuel from the pipeline fuel source 116 from entering the engine 108.

The transition may be initiated by one or more of the sensors 138*a-i* providing information to the controller 120 indicative of one or more operating parameters of the engine 108 and/or the system load 106. The operating parameters may be any operating parameter detectable by the one or more sensors 138*a-i*. For example, the operating parameter may be fuel pressure. The controller 120 may receive the information indicative of the one or more operating parameters and may process the information in one or more processors (one shown 182) included therein. The processor(s) 182 may be programmed to compare the information received to a desired engine operating parameter, which may be manually or automatically stored in a database (not shown) accessible by the processor 182 or may be calculated by the processor 182 as programmed. For example, the information received may be the fuel pressure of the alternative fuel, which may be determined by the processor(s) 182 to be less than the desired fuel pressure for the engine 108 to operate on alternative fuel at maximum power. In such an example, the controller 120 may then determine from the comparison that an amount of pipeline fuel should be added to maintain the operation of the engine 108 at maximum power.

In an instance in which the comparison of the information received and the desired operating parameter(s) of the engine 108 is determined by the controller 120 to warrant a transition of fuel supplied to the engine 108 of the power generation unit 104 from the alternative fuel to the pipeline fuel, the controller 120 may send respective instructions to the valves 122, 124, and 126. For example, the controller 120 may send an instruction to the valve 122 to open. As the valve 122 may be referred to as a shut-off valve, the instruction to open results in the valve 122 being fully-opened. The controller 120 may also send an instruction to the valve 124 to begin opening at a first or initial rate. As the valve 124 may be referred to as a progressive valve, the valve 124 may begin to open at an initial rate to an initial setpoint. The controller 120 may further send an instruction to the valve 126 to open to provide pipeline fuel to the mixer 152 at a desired rate to provide a fuel mixture having the desired air to fuel ratio. As the valve 126 may be an AFR valve, the instruction to open the valve 126 may result in the valve 126 being configured to provide fuel to the mixer 154 at a desired rate.

Before opening the valve 126, the controller 120 may send another instruction to the valve 124 to change the opening rate of the valve 124 to a second rate, which may be slower than the initial rate of opening of the valve 124. Correspondingly, the first setpoint may be changed to a second setpoint. By slowing opening the valve 124 before opening the valve 126, any leakage of the pipeline fuel flowing through the valve 126 may be reduced, thereby slowing down the introduction of gas into the engine 108 and maintaining the exhaust emissions at a predetermined level, thereby avoiding a sharp increase in exhaust emissions. The valve 124 may continue to open until achieving a fully-opened position. After opening the valves 124 and 126, the controller 120 may send an additional instruction to the valve 126 to increase the AFR to reach a final desired rate of pipeline fuel provided to the engine 108, such that the engine 108 may be capable of operating solely on the pipeline fuel.

Accordingly, the controller 120 may send respective instructions to the valves 128, 130, and 132. The controller 120 may send an instruction to valve 130 to begin to close at an initial rate. The controller 120 may send another instruction to the valve 130 to begin closing at a second rate at a specified time interval. The second rate may be faster than the initial rate of closing. By closing the valve 130 at a slower initial rate, large jumps in the gas pressure may be avoided, which results in the avoidance of misfiring. The controller 120 may send additional instructions to valves 128 and 132 to close, thereby closing each of the valves 128, 130, and 132 and preventing the flow of alternative fuel to the engine 108. Accordingly, the engine 108 may be running solely on pipeline fuel and the transition may have occurred without reducing the power output of the engine 108 and without excessive exhaust emissions, misfiring of the engine, or engine knocking during the transition. For the sake of brevity, the transition of fuel supplied to the engine 108 from the pipeline fuel to the alternative fuel will not be discussed in detail; however, those of ordinary skill in the art will appreciate that the operation thereof will be similar to the operation disclosed above.

Figure 2:
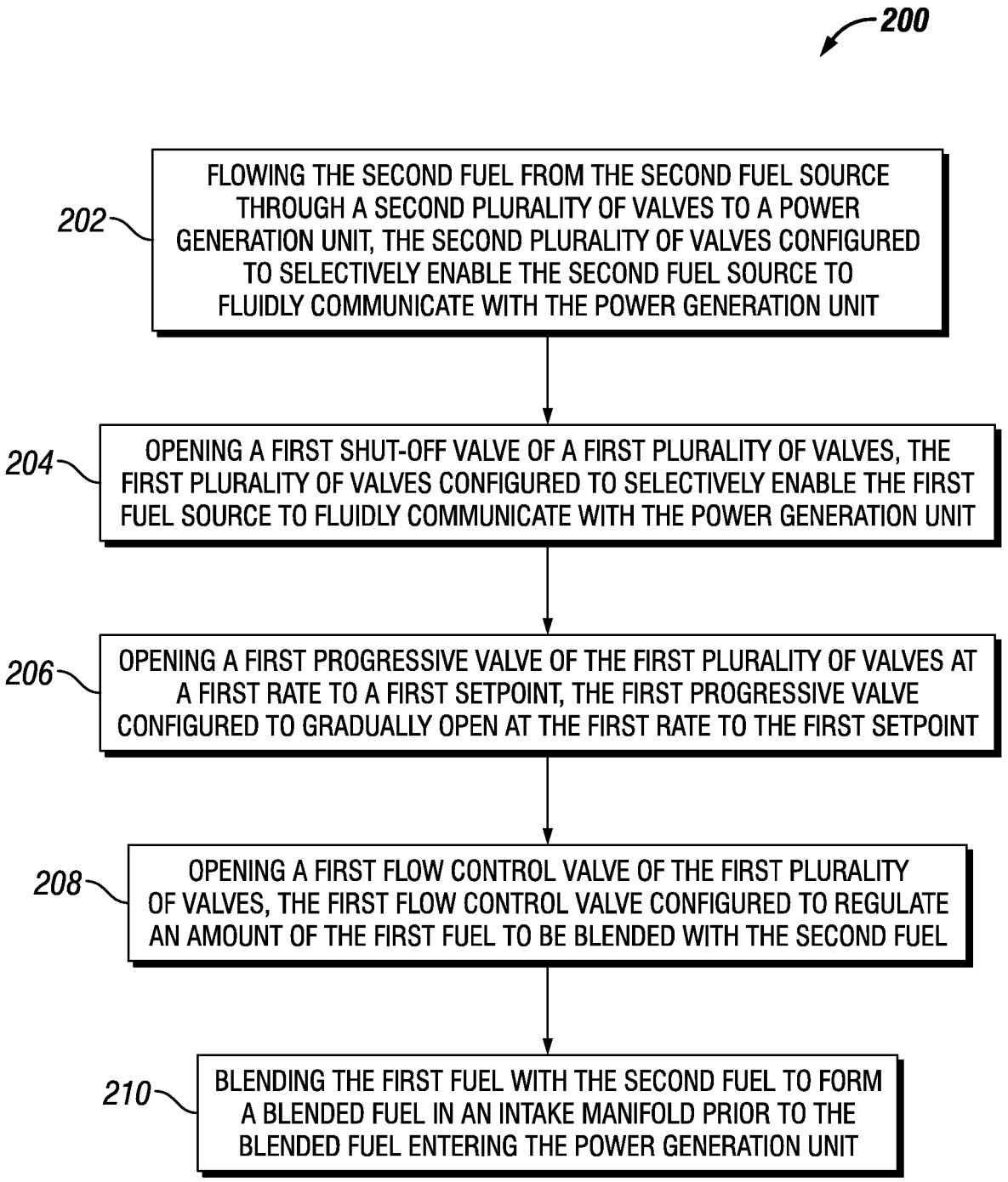
FIG. 2 illustrates a flowchart depicting a method for blending a first fuel from a first fuel source with a second fuel from a second fuel source, according to one or more embodiments disclosed.

Turning now to FIG. 2 with continued reference to FIG. 1, FIG. 2 illustrates a flowchart depicting a method 200 for blending a first fuel from a first fuel source with a second fuel from a second fuel source, according to one or more embodiments disclosed. The method 200 may include flowing the second fuel from the second fuel source through a second plurality of valves to a power generation unit, the second plurality of valves configured to selectively enable the second fuel source to fluidly communicate with the power generation unit, as at 202. The method 200 may also include opening a first shut-off valve of a first plurality of valves, the first plurality of valves configured to selectively enable the first fuel source to fluidly communicate with the power generation unit, as at 204.

The method 200 may further include opening a first progressive valve of the first plurality of valves at a first rate to a first setpoint, the first progressive valve configured to gradually open at the first rate to the first setpoint, as at 206. The method 200 may also include opening a first flow control valve of the first plurality of valves, the first flow control valve configured to regulate an amount of the first fuel to be blended with the second fuel, as at 208. The method 200 may further include blending the first fuel with the second fuel to a form a blended fuel in an intake manifold prior to the blended fuel entering the power generation unit, as at 210.

The method 200 may also include opening the first progressive valve of the first plurality of valves at a second rate to a second setpoint prior to the opening of the first flow control valve, the first progressive valve configured to gradually open at the second rate to the second setpoint, and the second rate being less than the first rate. The method 200 may further include detecting an operating parameter of the power generation unit via a sensor communicatively coupled to a controller, comparing the operating parameter detected by the sensor with another operating parameter via the controller, and transmitting an instruction via the controller to open at least one of the first shut-off valve, the first progressive valve, and the first flow control valve based on the comparison of the operating parameter detected by the sensor with the another operating parameter.

As provided in the method 200, the first shut-off valve, the first progressive valve, and the first flow control valve may be fluidly coupled in series between the first fuel source and the intake manifold, and the second plurality of valves may include a second shut-off valve, a second progressive valve, and a second flow control valve fluidly coupled in series between the second fuel source and the intake manifold. Further, as provided in the method 200, the first flow control valve may be a smart valve capable of sending information to the controller related to an operating parameter of the first flow control valve, and the first shut-off valve may be configured to be in a fully opened position or a fully closed position.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method for blending a first fuel from a first fuel source with a second fuel from a second fuel source, comprising:

flowing the second fuel from the second fuel source through a second plurality of valves to a power generation unit, the second plurality of valves configured to selectively enable the second fuel source to fluidly communicate with the power generation unit;

opening a first shut-off valve of a first plurality of valves, the first plurality of valves configured to selectively enable the first fuel source to fluidly communicate with the power generation unit, opening a first progressive valve of the first plurality of valves at a first rate to a first setpoint, the first progressive valve configured to gradually open at the first rate to the first setpoint;

opening a first flow control valve of the first plurality of valves, the first flow control valve configured to regulate an amount of the first fuel to be blended with the second fuel, blending the first fuel with the second fuel to a form a blended fuel in an intake manifold prior to the blended fuel entering the power generation unit, and opening the first progressive valve of the first plurality of valves at a second rate to a second setpoint prior to the opening of the first flow control valve, the first progressive valve configured to gradually open at the second rate to the second setpoint, and the second rate being less than the first rate.

2. The method of claim 1, further comprising:

detecting an operating parameter of the power generation unit via a sensor communicatively coupled to a controller; and comparing the operating parameter detected by the sensor with another operating parameter via the controller; and transmitting an instruction via the controller to open at least one of the first shut-off valve, the first progressive valve, and the first flow control valve based on the comparison of the operating parameter detected by the sensor with the another operating parameter.

3. The method of claim 2, wherein:

the first shutoff valve, the first progressive valve, and the first flow control valve are fluidly coupled in series between the first fuel source and the intake manifold; and the second plurality of valves comprises a second shut-off valve, a second progressive valve, and a second flow control valve fluidly coupled in series between the second fuel source and the intake manifold.

4. The method of claim 2, wherein:

the first flow control valve is a smart valve capable of sending information to the controller related to an operating parameter of the first flow control valve; and the first shut-off valve is configured to be in a fully opened position or a fully closed position.

5. A system for blending a first fuel from a first fuel source with a second fuel from a second fuel source, the system comprising:

a second plurality of valves arranged to flow the second fuel from the second fuel source to a power generation unit, the second plurality of valves configured to selectively enable the second fuel source to fluidly communicate with the power generation unit;

a first shut-off valve of a first plurality of valves, the first plurality of valves configured to selectively enable the first fuel source to fluidly communicate with the power generation unit;

a first progressive valve of the first plurality of valves being opened at a first rate to a first setpoint, the first progressive valve configured to gradually open at the first rate to the first setpoint;

a first flow control valve of the first plurality of valves being opened to regulate an amount of the first fuel to be blended with the second fuel; and an intake manifold arranged to blend the first fuel with the second fuel to form a blended fuel prior to the blended fuel being supplied to the power generation unit, wherein the first progressive valve of the first plurality of valves being opened at a second rate to a second setpoint prior to the first flow control valve being opened, the first progressive valve configured to gradually open at the second rate to the second setpoint, and the second rate being less than the first rate.

6. The system of claim 5, wherein the first fuel is biogas or syngas; and the second fuel is natural gas or liquid petroleum.

* * * * *